US005865268A

United States Patent [19]

Finneran et al.

[11] Patent Number: 5,865,268

[45] Date of Patent: Feb. 2, 1999

[54] LADDER ANCHORING SYSTEM

[76] Inventors: Marilyn Finneran; Patrick Finneran, both of 94 Ackerly La., Lake Ronkonkoma, N.Y. 11779

[21] Appl. No.: 106,985

[22] Filed: Jun. 29, 1998

[51] Int. Cl.[6] ..... E04G 5/02

[52] U.S. Cl. ..... 182/107; 182/109

[58] Field of Search ..... 182/107, 108, 182/109

[56] References Cited

U.S. PATENT DOCUMENTS 4,039,047 8/1977 Larson et al. ..... 182/107 X

FOREIGN PATENT DOCUMENTS 2268215 1/1994 United Kingdom .

*Primary Examiner*—Daniel P. Stodola
*Assistant Examiner*—Hugh B. Thompson
*Attorney, Agent, or Firm*—Goldstein & Canino

[57] ABSTRACT

A ladder anchoring system, using a ladder having a pair of side rails and rungs extending between the side rails. The side rails each have a central portion and a pair of flanges. The side rails have an inner side where the rungs are attached, and an outer side. A spike assembly is mounted to each of the side rails, between the flanges and the outer side. The spike assembly includes a spike which is mounted for slidable movement such that it selectively extends below the ladder bottom so that it may extend into ground below the ladder, and selectively does not extend below the ladder bottom for safe storage and transportation. A kick plate mounted to the spike facilitates penetration of the spike in the ground.

5 Claims, 3 Drawing Sheets

LADDER ANCHORING SYSTEM

BACKGROUND OF THE INVENTION

The invention relates to a ladder anchoring system. More particularly, the invention relates to a system for anchoring a ladder into the ground below for ensuring safety to the user.

A ladder is a tool used by people in almost every trade. A ladder makes inaccessible locations suddenly accessible. However there are certain dangers associated with ladder use. Level ground is not always present to position the ladder upon, and often workers can only try their best to stabilize the ladder before climbing. However, even when placed on level ground and against a solid building, a ladder can become more and more unstable as the user climbs. The ladder can easily "kick-out" from the building surface, or slide laterally on the building surface and fall. A falling ladder not only injures the worker climbing the ladder, but can easily injure others working in the vicinity.

Homeowners tend to use ladders even more than tradespeople. However, for the typical homeowner, climbing a ladder is not an everyday occurence. Thus, many homeowners climb ladders without properly positioning the ladder first. As a result countless homeowners are injured every year when the ladder they climb falls. Many of these injuries could be prevented if the ladder were properly anchored before it were climbed.

U.S. Pat. Nos. 302,733 to Jayne; 369,084 to Smith; and 375,249 to Bacon each disclose ladders having spiked members permanently attached at the bottom end thereof. Although these ladders might quite effectively secure themselves into the ground surface, they are unsuitable for use indoors. Further, they can easily cause serious injury to the user or others while the ladder is being transported.

U.S. Pat. No. 5,054,579 to Moson discloses a ladder having an anchoring system. The anchoring system in Moson is simply a pair of ordinary stakes which each have a hook for engaging the lowest ladder rung or extending through an aperature near the side rails. However, since the stakes are not permanently attached to the ladder, there is a great possibility that they will be lost, or will simply not be used everytime the ladder is used.

While these units may be suitable for the particular purpose employed, or for general use, they would not be as suitable for the purposes of the present invention as disclosed hereafter.

SUMMARY OF THE INVENTION

It is an object of the invention to produce a ladder anchoring system which is suitable for attaching a ladder to the ground to prevent the ladder from suddenly moving while a user is relying upon the ladder for support. Accordingly, a pair of spikes are provided for engaging the ground surface and extending a short distance therein, for anchoring the ladder and preventing inadvertant movement thereof.

It is another object of the invention to provide a ladder anchoring system in which the anchoring system is retractable so that it cannot cause injury when the anchoring system is not in use. Accordingly, the anchoring system comprises a pair of spike assemblies which are recessed within the flanges of the ladder side rails. The spike assemblies are movable on tracks to selectively extend below the ladder bottom to anchor into the ground surface or retract above the ladder bottom for storage.

It is a further object of the invention to provide a ladder anchoring system which is easy to use, and requires little strength to achieve a secure anchoring of the ladder. Accordingly, the spike assembly has a fold out kick plate which allows the user to step down upon said kick plate to push the spike into the ground. The kick plate retracts parallel to the side rail when not in use.

The invention is a ladder anchoring system, using a ladder having a pair of side rails and rungs extending between the side rails. The side rails each have a central portion and a pair of flanges. The side rails have an inner side where the rungs are attached, and an outer side. A spike assembly is mounted to each of the side rails, between the flanges and the outer side. The spike assembly includes a spike which is mounted for slidable movement such that it selectively extends below the ladder bottom so that the spike may extend into ground below the ladder, and selectively retracts so that the spike does not extend below the ladder bottom for safe storage and transportation. A kick plate mounted to the spike facilitates penetration of the spike in the ground.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
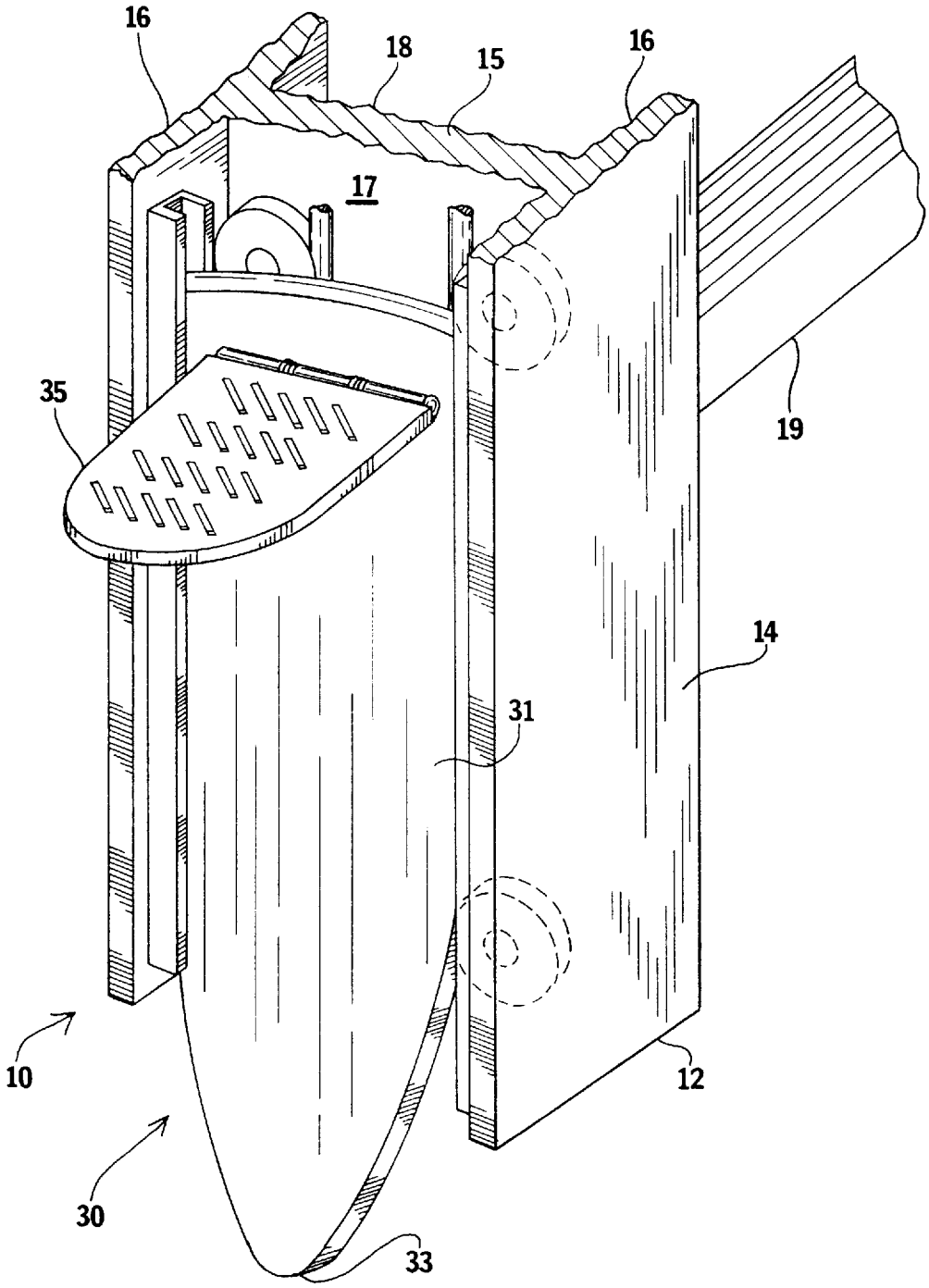
FIG. 1 is a diagrammatic perspective view, illustrating a bottom portion of a ladder having the anchoring system according to the present invention.

FIG. 1 illustrates a ladder 10 having a bottom 12, vertical side rails 14, and rungs 19 which extend horizontally between the side rails 14. Only one of said side rails 14 and one rung 19 is illustrated in this cutaway view.

The side rails 14 are the shape of an I-beam, having a central portion 15 and a pair of flanges 16 extending transverse to the central portion 15, wherein the central portion 15 connects said flanges 16. The flanges 16 extend parallel to each other. The central portion 15 has an outer side 17 and an inner side 18. The inner side 18 of each side rail 14 faces the inner side of the other side rail 14. The rungs 16 extend between the inner sides 18.

The anchoring system comprises a spike assembly 30 that is nestled between the flanges 16 and the outer side 17 of the central portion 15. The spike assembly 30 includes a spike 31, having a pointed end 33. The spike assembly 30 includes a kick plate 35 which is attached to the spike 31 with a hinge 37. As illustrated in FIG. 1, the kick plate 35 is extending substantially perpendicular to the spike 31.

The spike assembly 30 is slidably mounted to ladder side rail 14 so that it can move upward and retract the spike above the ladder bottom 12, and downward wherein the spike 31 extends beyond the ladder bottom 12 so that it can extend into the ground beneath the ladder 10.

Figure 2:
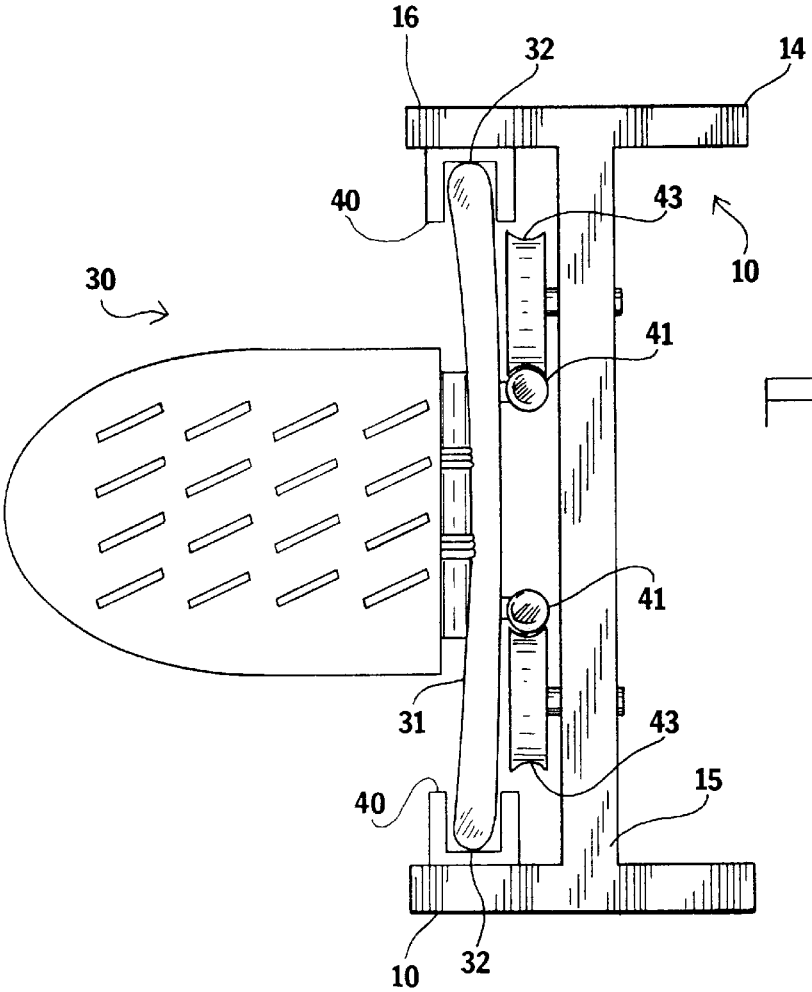
FIG. 2 is a top plan view of the ladder, illustrating guide tracks and roller wheels which attach the spike assembly to the ladder rail.

Referring to FIG. 2, a pair of guide tracks 40 extend on the flanges 16, opposite each other. The spike 31 has two longitudinal edges 32 which extend in the guide tracks. Overall, the spike 31 is concave between its longitudinal edges 32. The concave curvature of the spike 31 enhances its strength, so that it resists bending when the spike 31 penetrates a hard ground surface.

The spike assembly 30 further has a pair of roller rods 41 rigidly mounted to the spike 31. The roller rods 41 extend vertically on the spike 31 between the spike 31 and the central portion 15 of the side rail 14. At least two roller wheels 43 are mounted to the central portion 15, which engage the roller rods 41. The wheels ease the vertical movement of the roller rods 41, and thus the spike 31.

The guide tracks 40 and roller wheels 43 together allow the slidable movement of the spike assembly 30 with respect to the ladder 10. Thus the spike assembly 30 is movable between an extended position and a retracted position.

Figure 3:
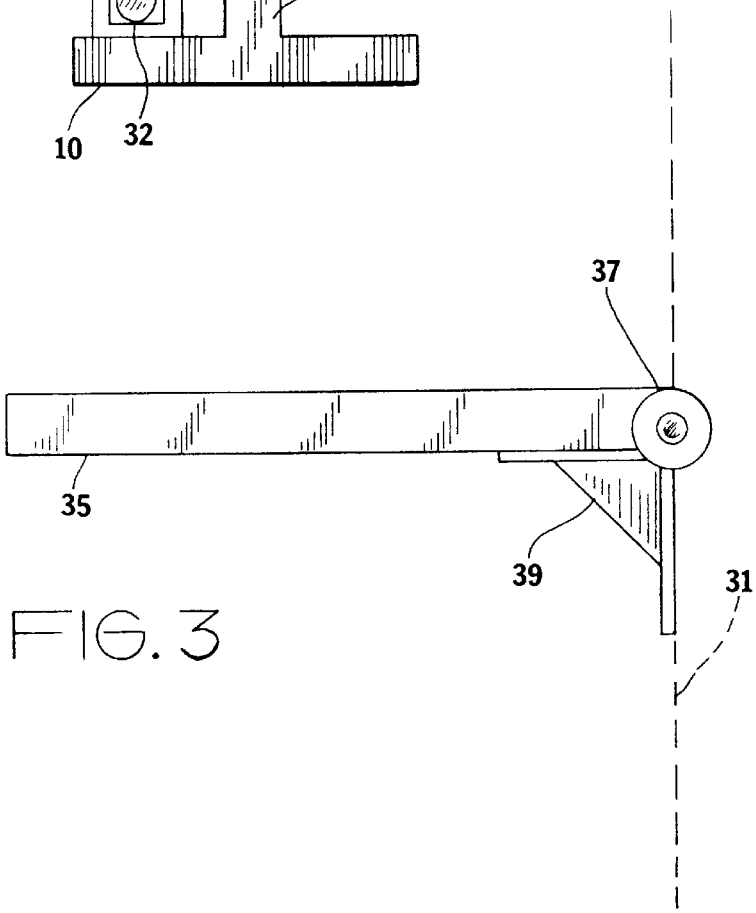
FIG. 3 is a side elevational view, illustrating the kick plate lowered for use.

Referring to FIG. 3, the kick plate 35 is illustrated in its operating position. The kick plate 35 is extending perpendicular to the spike 31. Further, a stop 39 is located on the spike 31 just below the hinge 37 to prevent the kick plate 35 from moving further downward beyond the perpendicular position illustrated. In addition, a spring may be integrated within the hinge to bias the kick plate 35 upward to its storage position indicated in FIG. 4, wherein the kick plate 35 extends substantially parallel to the spike 31 and thus parallel to the central portion 15 of the side rail 14.

Figure 4:
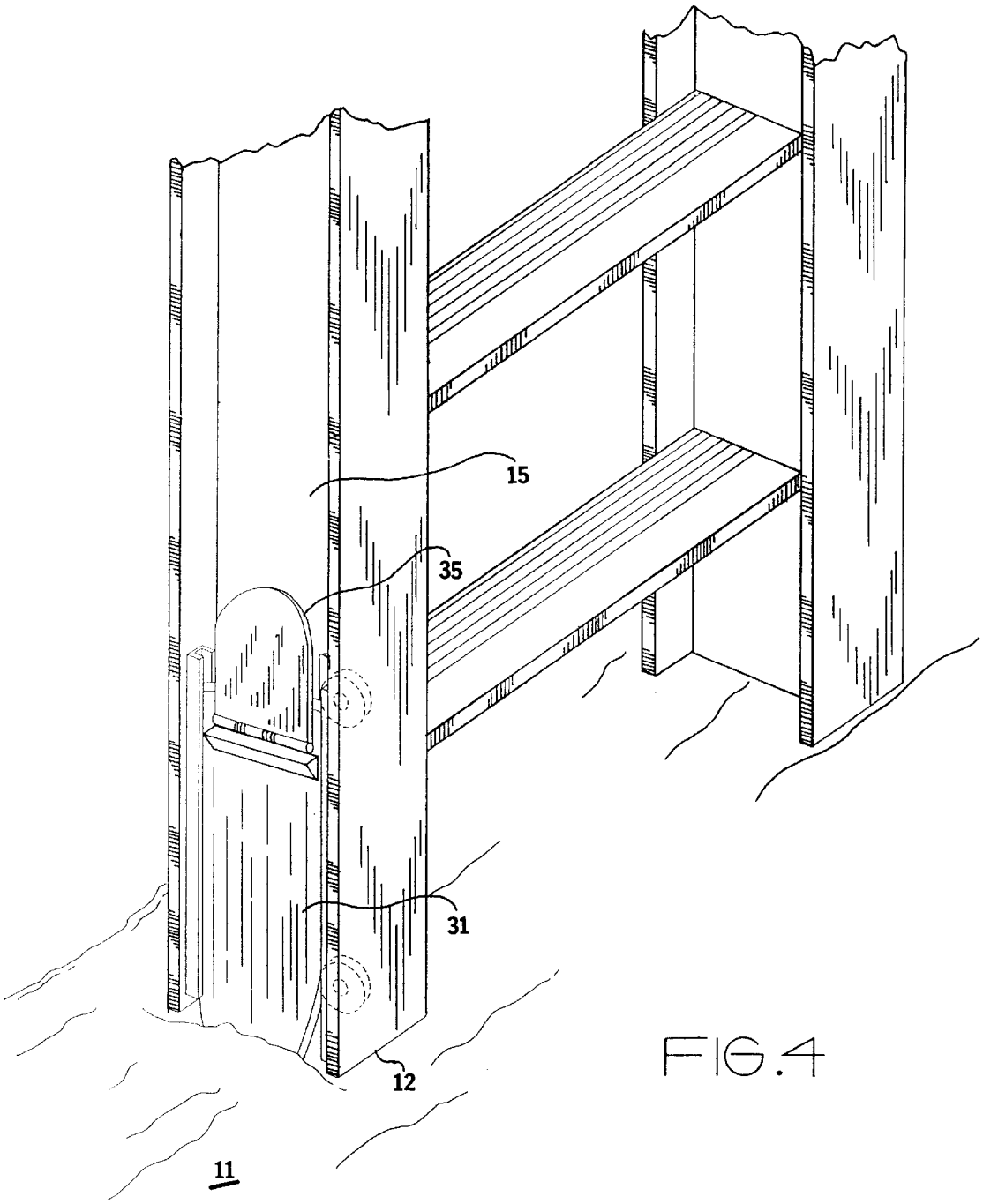
FIG. 4 is a diagrammatic perspective view, illustrating the ladder anchored to the ground, wherein the spike is extending partially into the ground beneath the ladder and the kick plate is retracted upward.

Referring to FIG. 4, the bottom 12 of the ladder 10 is resting upon a ground surface 11. The spikes 31 have been extended into the ground surface 11, and the kick plate 35 has been retracted upward into its storage position. The ladder 10 is now securely anchored to the ground, and is ready to use.

In conclusion, herein is presented a ladder anchoring system which effectively secures a ladder to a ground surface with a pair of spikes which are slidably mounted along the outer side of the side rails. The spikes are selectively extended below the ladder bottom so that they can extend into the ground, and are selectively withdrawn above the ladder bottom for storage and transportation of the ladder.

What is claimed is:

1. A ladder having an anchoring system said ladder having a pair of side rails and rungs extending between the side rails, the side rails having a central portion having an inner side and an outer side, the side rails also having flanges extending transverse to the central portion, said anchoring system comprising:

a spike assemblv mounted to the outer side of the central portion between the flanges, the spike assembly having a spike, the spike assembly slidably mounted so that the spike assembly is capable of vertical movement between an extended position wherein the spike extends beyond the bottom of the ladder and a retracted position wherein the spike does not extend beyond the bottom of the ladder;

a kick plate, the kick plate extending perpendicular to the spike so that it may be stepped down upon to push the spike into the ground, the kick plate being attached to the spike with a hinge, so that the kick plate may be folded up against the spike.

2. The ladder anchoring system as recited in claim 1, wherein the spike further comprises a stop located immediately below the hinge, to prevent the kick plate from extending below a position where it is perpendicular to the spike.

3. The ladder anchoring system as recited in claim 2, wherein guide tracks are mounted on the flanges of the ladder, and the spike has longitudinal edges which extend vertically through the guide tracks to guide the vertical movement of the spike assembly.

4. The ladder anchoring system as recited in claim 3, wherein the spike assembly has roller rods vertically mounted to the spike between the spike assembly and the outer side of the central portion of the rail, and roller wheels are mounted to the ladder which engage the roller rods to ease the vertical movement of the spike assembly with respect to the rail.

5. The ladder anchoring system as recited in claim 4, wherein the spike is concave between the longitudinal edges.

* * * * *